US005167920A

United States Patent [19]

Skibo et al.

[11] Patent Number: 5,167,920

[45] Date of Patent: * Dec. 1, 1992

[54] CAST COMPOSITE MATERIAL

[75] Inventors: Michael D. Skibo, Leucadia; David M. Schuster, La Jolla, both of Calif.

[73] Assignee: Dural Aluminum Composites Corp., San Diego, Calif.

[ * ] Notice: The portion of the term of this patent subsequent to Nov. 22, 2005 has been disclaimed.

[21] Appl. No.: 259,581

[22] Filed: Oct. 18, 1988

Related U.S. Application Data

[63] Continuation of Ser. No. 856,338, May 1, 1986, Pat. No. 4,786,467.

[51] Int. Cl.[5] ..... C22L 21/02

[52] U.S. Cl. ..... 420/548; 420/526

[58] Field of Search ..... 420/548, 528

[56] References Cited

U.S. PATENT DOCUMENTS 4,759,995 7/1988 Skibo et al. ..... 420/590
4,786,467 11/1988 Skibo et al. ..... 420/129

FOREIGN PATENT DOCUMENTS 0045510 2/1982 European Pat. Off. .
2921452 12/1979 Fed. Rep. of Germany .
60-6265 1/1985 Japan .
1334358 10/1973 United Kingdom .
2088761 11/1981 United Kingdom .

*Primary Examiner*—Stephen J. Lechert, Jr.
*Attorney, Agent, or Firm*—Gregory Garmong

[57] ABSTRACT

A method and apparatus for preparing cast composite materials of nonmetallic particles in a metallic matrix, wherein particles are mixed into a molten metallic alloy to wet the molten metal to the particles, and the particles and metal are sheared past each other to promote wetting of the particles by the metal. The mixing occurs while minimizing the introduction of gas into the mixture, and while minimizing the retention of gas at the particle-liquid interface. Mixing is done at a maximum temperature whereat the particles do not substantially chemically degrade in the molten metal during the time required for processing, and casting is done at a temperature sufficiently high that there is no solid metal present in the melt. Mixing is preferably accomplished with a dispersing impeller, or a dispersing impeller used with a sweeping impeller.

14 Claims, 6 Drawing Sheets

CAST COMPOSITE MATERIAL

This is a continuation of application Ser. No. 06/856,338, filed May 1, 1986 U.S. Pat. No. 4,786,467.

BACKGROUND OF THE INVENTION

This invention relates to metal matrix composite materials and, more particularly, to the preparation of such materials by a casting process.

This application is a continuation in part of pending PCT application PCT/US84/02055 (which names the United States), filed Dec. 12, 1984, for which priority is claimed, which in turn is a continuation in part of abandoned U.S. Pat. No. 06/501,128, filed Jun. 6, 1983, abandoned for which priority is claimed.

Metal matrix composite materials have gained increasing acceptance as structural materials. Metal matrix composites typically are composed of reinforcing particles such as fibers, grit, powder or the like that are embedded within a metallic matrix. The reinforcement imparts strength, stiffness and other desirable properties to the composite, while the matrix protects the fibers and transfers load within the composite. The two components, matrix and reinforcement, thus cooperate to achieve results improved over what either could provide on its own.

Twenty years ago such materials were little more than laboratory curiosities because of very high production costs and their lack of acceptance by designers. More recently, many applications for such materials have been discovered, and their volume of use has increased. The high cost of manufacturing composite materials remains a problem that slows their further application, and there is an ongoing need for manufacturing methods that produce composite materials of acceptable quality at a price that makes them competitive with more common substitutes such as high-strength alloys.

Unreinforced metallic alloys are usually produced by melting and casting procedures. Melting and casting are not easily applied in the production of reinforced composite materials, because the reinforcement particles may chemically react with the molten metal during melting and casting. Another problem is that the molten metal often does not readily wet the surface of the particles, so that mixtures of the two quickly separate or have poor mechanical properties after casting.

In the past, attempts to produce metal alloy-particulate composites by the addition of particulate material to the molten alloy, followed by casting the resulting mixture, have not been particularly successful. It has been postulated that the major difficulty with such an approach is that the most desirable particulates, such as, for example, silicon carbide, are not readily wetted by molten metal alloys and that, because of this, the introduction and retention of the particles in the liquid matrix is extremely difficult, if not impossible.

An ability to prepare such composites by melting and casting would have important technical and economic advantages, and consequently there have been many attempts to produce such composites. It has been suggested that wettability could be achieved by coating the particles with nickel. Another technique has involved promoting wetting of the refractory particles in the melt by saturating the melt with anions of the refractory particles. Another method involves the addition of such elements as lithium, magnesium, silicon, and calcium into the melt prior to the addition of the refractory particles. Still another method involves the addition of particles of silicon carbide to a vigorously agitated, partially solidified slurry of the alloy, maintained at a temperature well below the liquidus temperature of the alloy so that solid metal particles are present. Still another attempt to improve the wettability of the particulates has involved subjecting large particulate materials and fibers in the melt to ion bombardment, mechanical agitation, vacuum, and heat prior to mixing with the molten alloy, in order to remove moisture, oxygen, adsorbed gases, and surface film therefrom.

The fabrication of aluminum alloy-alumina fiber composites in one approach uses a stirrer blade with a paddle type design, the blade being designed to move very close to the walls of the crucible to induce a high shear and create a vortex for introduction of the fibers into the melt. The process also requires a baffle, which is immersed slightly below the surface of the melt with a tilt angle of about 45° in the direction of flow, the function of the baffle being to divert the flow pattern in the melt and to aid in the entrapment of the fibers below the surface of the melt.

In yet another approach, composites such as aluminum-silicon carbide particulate composites are prepared using the vortex method of dispersion of particles. The particles are pre-heated for 60 minutes at 900° C. prior to addition to the melt to aid in their introduction into the melt. The vortex is created by stirring the melt rapidly with a mechanical impeller, which causes a deep vortex to form. The particulate is added through the sides of the vortex in an effort to promote rapid incorporation of the particles into the melt and wetting of the particles by the molten metal. Composites produced by this method tend to have poor bonding of the metal to the particulate, as well as entrapped gas.

In a variation of melting and casting techniques, the reinforcement is provided as a mat of packed material, and the molten metallic alloy is forced under pressure into the spaces remaining. This process, termed infiltration or squeeze casting, produces a composite that is not well bonded internally. Moreover, the process is expensive and difficult to use, since an apparatus specific to each part must be prepared.

All of these prior melting and casting techniques have drawbacks owing largely to the specialized, costly modifications that must be done to the particulate or the melted alloy, in order to accomplish wetting. Moreover, the techniques have not been successful in manufacturing composite materials for large-scale, industrial applications. Instead, the primary method for producing composites having a metal matrix and particulate reinforcement has been powder metallurgical processes which are different from the melting and casting procedures.

In the powder metallurgical processes, carefully sized aluminum powder is mixed with silicon carbide particulate in the presence of an organic solvent. A solvent is necessary to prevent a pyrophoric reaction between the aluminum and oxygen in the air. The mixture is poured into drying trays, and the solvent allowed to evaporate over a period of time. The dry, unconsolidated sheets, which are approximately 0.040 inches thick, are stacked to form a plate of the desired thickness. This fragile stack of sheets is placed into a press and heated to the liquid-solid regime of the matrix, where the metal is slushy in character. The stack is then pressed, consolidating the particles, and forming a solid plate.

In another powder metallurgical process, the silicon carbide particles and aluminum are mixed, as above, but the mixed powder is poured into a cylindrical mold, and consolidated by vacuum hot pressing into a cylindrical billet. Because of the high costs of raw materials, particularly the aluminum powders, and the complexities of the fabrication process, the current costs of the composites discourage their large-scale use in many areas. Both powder processes result in considerable segregation of alloying elements in the metallic matrix material, which is undesirable because of its adverse effect on mechanical and physical properties.

Both of the commercial processes above described result in composites which, while having high moduli and adequate strength, have ductility and formability which are low. The complex superheating and deformation cycle which is required in the above processes produce extensive elemental segregation in the matrix, which decreases ductility and prevents the attainment of maximum matrix and composite strengths. A further problem is the retention of the surface oxide which coated the original aluminum powder particles, this serving to further decrease matrix ductility. It would also appear that the oxide coating prevents the complete wetting of the carbide particles, thus further limiting the ultimate composite properties.

Thus, there exists a continuing need for a fabrication method and apparatus using melting and casting to produce metallic composites containing particulate reinforcement, which are technically acceptable with good properties. The method and apparatus must also be acceptable in that they produce the composite materials relatively inexpensively, both as compared with other methods of manufacturing composites and with methods of manufacturing competitive materials. The present invention fulfills this need, and further provides related advantages.

SUMMARY OF THE INVENTION

The present invention provides a method and apparatus for preparing a metallic matrix composite material having wetted nonmetallic refractory ceramic particulate reinforcement dispersed throughout. The composite material has properties superior to those of the matrix alloy due to the presence of the wetted particulate reinforcement, and is particularly noted for its high stiffness. The composite material is technically and economically competitive with unreinforced high-strength alloys such as aluminum and titanium in certain applications. The composite is formable by standard industrial procedures such as rolling and extrusion into semi-finished products. The cost of preparing the composite material is presently about one-third to one-half that of competitive methods for producing composite materials. For high-volume production, it is projected that the cost of preparing the composite material will fall to one-tenth that of competitive methods.

In accordance with the invention, a method for preparing a composite of a metallic alloy reinforced with particles of a nonmetallic material comprises melting the metallic material; adding particles of the nonmetallic material to the molten metal; mixing together the molten metal and the particles of the nonmetallic material to wet the molten metal to the particles, under conditions that the particles are distributed throughout the volume of the melt and the particles and the metallic melt are sheared past each other to promote wetting of the particles by the melt, said mixing to occur while minimizing the introduction of gas into, and while minimizing the retention of gas within, the mixture of particles and molten metal, and at a temperature whereat the particles do not substantially chemically degrade in the molten metal in the time required to complete the step of mixing; and casting the resulting mixture at a casting temperature sufficiently high that substantially no solid metal is present.

Preferably, the metallic material is an aluminum alloy, although other materials such as magnesium alloys can also be used. The nonmetallic material is preferably a metal oxide, metal nitride, metal carbide or metal silicide. The most preferred composite material is silicon carbide or aluminum oxide particulate reinforcement in an aluminum alloy matrix.

In conventional casting procedures, it is usually desirable to cast molten metal at a high temperature to decrease the viscosity of the metal so that it can be readily cast. However, consideration of reaction of the particulate and molten alloy enters into the selection of temperature for the present method. During the mixing and casting steps, the molten metal must not be heated to too high a temperature, or there may be an undesirable reaction between the particulate and the molten metal which degrades the strength of the particulate and the properties of the finished composite. The maximum temperature is therefore chosen so that a significant degree of reaction does not occur between the particles and the metallic melt in the time required to complete processing. The maximum temperature is found to be about 20° C. above the liquidus for metallic alloys containing volatile, reactive alloying elements, about 70° C. above the liquidus for most common metallic alloys, and about 100° C. to about 125° C. above the liquidus for metallic alloys containing alloying elements that promote resistance to reaction.

A vacuum is applied to the molten mixture of metal and particulate during the mixing step in the preferred approach. The vacuum reduces the atmospheric gases available for introduction into the melt, and also tends to draw dissolved, entrapped and adsorbed gases out of the melt during mixing. The magnitude of the vacuum is not critical for metal alloys that do not contain volatile constituents such as zinc or magnesium. However, where volatile elements are present, the vacuum preferably does not exceed about 10–30 torr, or the volatile elements are drawn out of the alloy at a high rate. The preferred vacuum is found to provide the favorable reduction of gases, while minimizing loss of volatile elements.

In a preferred batch process, mixing is accomplished by a rotating dispersing impeller that stirs the melt and shears the particles and the molten metal past each other without introducing gas into the mixture. The impeller design minimizes the vortex at the surface of the melt. The presence of a vortex has been found to be undesirable, in that it draws atmospheric gas into the melt. In a particularly preferred batch process, mixing is accomplished with a mixing head having a rotating dispersing impeller and a rotating sweeping impeller, the dispersing impeller shearing the particles and the molten metal past each other without introducing gas into the mixture and without stabilizing dissolved, entrapped, and adsorbed gas already present in the mixture, and the sweeping impeller promoting the movement of particles and molten metal into the vicinity of the impeller to achieve a thorough mixing of the entire volume of material. The dispersing impeller preferably rotates at about 2500 revolutions per minute (rpm) and the sweeping impeller preferably rotates at about 45 rpm, although these values are not critical and can be varied widely with acceptable results.

An embodiment of the present invention therefore is found in a method for preparing a composite of a metallic alloy reinforced with particles of a nonmetallic material, comprising forming a mixture of the molten metallic alloy and the particles; maintaining the mixture in a temperature range of from about the liquidus temperature of the metallic material to a temperature whereat the particles do not substantially degrade during the time required for the subsequent processing steps; mixing together the particles and the molten metal for a time sufficient to wet the molten metal to the particles and to distribute the particles throughout the molten metal, using a rotating dispersing impeller immersed in the molten mixture to shear the particles and molten metal past each other while minimizing the introduction of gas into the mixture and while minimizing the retention of gas already present in the mixture, said step of mixing to occur with a vacuum applied to the mixture; and casting the resulting mixture. Means such as a sweeping impeller is preferably provided to move the particles and metal in the molten mixture into the vicinity of the dispersing impeller.

The composite material made by the method of the invention has a cast microstructure of the metallic matrix, with particulate distributed generally evenly throughout the cast volume. The particulate is well bonded to the matrix, since the matrix was made to wet the particulate during fabrication. No significant oxide layer is interposed between the particulate and the metallic matrix. The cast composite is particularly suitable for processing by known primary forming operations such as rolling and extruding to useful shapes. The properties of the cast or cast and formed composites are excellent, with high stiffness and strength, and acceptable ductility and toughness. Composite materials have been prepared with volume fractions of particulate ranging from about 5 to about 40 percent, so that a range of strength, stiffness and physical properties of the composite are available upon request.

Apparatus for preparing a composite material of a metallic alloy reinforced with particles of a nonmetallic material comprises means for containing a mass of the metallic alloy in the molten state; heating means for heating the molten alloy in the means for containing to a temperature of at least the liquidus temperature of the metallic alloy; and mixing means for mixing the particles together with the molten metal in the vessel means to wet the molten metal to the particles, whereby the particles are sheared past each other to promote wetting of the particles by the melt, while minimizing the introduction of gas into the mixture and minimizing the retention of gas in the mixture, the presence of the gas tending to inhibit wetting of the molten metal to the particles. A dispersing impeller or combination of dispersing impeller and sweeping impeller of the type previously described can be used in this apparatus.

It will now be apparent that the method and apparatus of the present invention present an important and significant advance in the art of manufacturing composite materials. The composite materials are produced economically by apparatus which incorporates the particulate reinforcement directly into the molten metal, without the need to coat or otherwise treat the particles before incorporation and using conventional metallic alloys. The cast composite is of high quality and exhibits excellent physical properties, and can be subsequently processed into useful shapes. The method is economically competitive with methods of preparing unreinforced alloys, and produces composites much less expensively than do other technologies. Other features and advantages of the present invention will become apparent from the following more detailed discussion, taken in conjunction with the accompanying drawings, which illustrate, by way of example, the principles of the invention.

DETAILED DESCRIPTION OF THE PREFERRED EMBODIMENT

Figure 1:
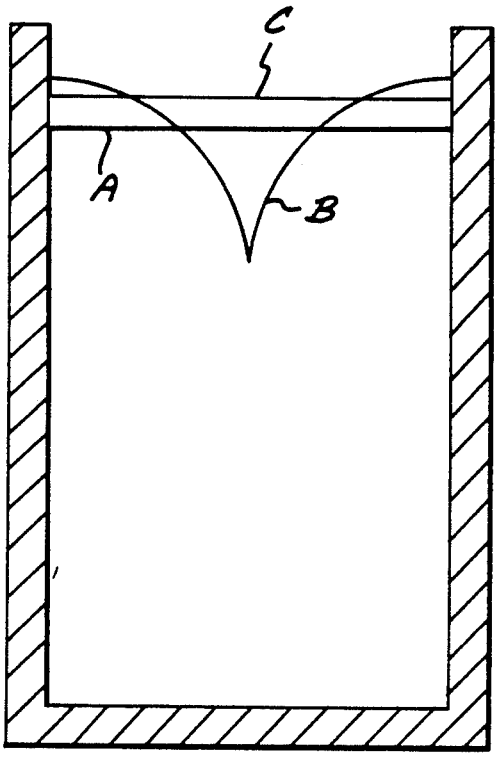
FIG. 1 is a schematic side sectional view of a melt in a crucible before, during, and after conventional impeller mixing.

The present invention is embodied in a process and apparatus for preparing a composite material by incorporating particulate nonmetallic reinforcement into a molten mass of the matrix material. To produce an acceptable composite material, the molten metal must wet the surface of the particulate. If wetting is not achieved, it is difficult to disperse the particulate throughout the mass of metal, since the particulate rises to the surface even after being forced below the surface by a mixer. Unwetted particulate also results in unsatisfactory mechanical properties of the cast solid composite material, especially for particulate matter having a relatively short ratio of length to thickness, also termed the aspect ratio. For particles having a short aspect ratio on the order of 2–5, there must be good bonding at the interface of the particle and the matrix to achieve good strength and stiffness values. Good bonding cannot be readily achieved in the absence of wetting of the molten matrix to the particles.

Wetting of a metal to a particle is a phenomenon involving a solid and a liquid in such intimate contact that the adhesive force between the two phases is greater than the cohesive force within the liquid. Molten metals such as aluminum and aluminum alloys wet and spread on many typical nonmetallic particulate reinforcement materials under the proper conditions, but the presence of certain contaminants at the surface between the metal and the particles inhibits wetting. Specifically, gas and oxides adhered to a surface inhibit wetting of a molten metal to that surface. It is therefore necessary to minimize the presence and effect of gas and oxides otherwise interposed between the molten metal and the particulate in order to permit the molten metal to wet the surface, thereby retaining the particulate within the molten metal during mixing and casting, and promoting good interfacial bonding properties after casting and solidification.

There are several sources of gas in a molten mixture of the metal and particulate that can interfere with wetting of the metal to the particles. Gas is adsorbed on the surface of the particles that are initially provided. Even after thorough cleaning, gases immediately reattach themselves to the surface of the particles, even in high vacuum. These layers inhibit the subsequent wetting. Gas bubbles readily attach themselves to the surfaces of the particulate after immersion in the molten metal, since the surface sites tend to be most favorable for the attachment or nucleation of bubbles.

Gas is present in the molten metal in a dissolved or physically entrained state. Gaseous species are also present as oxides on the surface of the metals. The preferred metal for use in the present invention, aluminum, is well known for the rapid formation of an oxide on the surface of the liquid or solid metal, and this oxide directly inhibits wetting.

Gas can also be introduced into the molten mixture of metal and particulate by the mixing technique used to mix the two together to promote wetting. In the prior practice for mixing, a paddle-type or ship's propeller-type of mixing impeller has been used to promote mixing and wetting of the metal and particulate. The melt is stirred at a high rate to form a vortex above the impeller, and then the particulate is added into the sides or bottom of the vortex. It has been thought that the metal flow along the sides of the vortex promotes mixing.

Instead, it has now been found that the presence of a vortex inhibits wetting, the ultimate objective of the mixing procedure, by incorporating gas into the mixture. Gas is physically drawn into the molten mixture by the vortex, most noticeably when there is a gaseous atmosphere above the melt but also when the mixing is accomplished in vacuum.

FIG. 1 graphically illustrates the effect of vortex mixing. An experiment was performed to determine the extent of incorporation of gas into the molten mixture. A mixture of aluminum and silicon carbide particulate was melted in a crucible, and line A represents the surface of the melt. The melt was then rapidly stirred in argon with a conventional mixing impeller to generate a vortex at the surface, and line B represents the shape of the surface during mixing while the deep vortex characteristic of rapid stirring of metals is present. When mixing was stopped, the surface level of the melt, represented by line C, was significantly higher than before mixing, line A. The difference was due to gas that had been drawn into the melt by the vortex and entrapped during the mixing process. This physical entrainment is particularly significant for melts containing solid particulate, since the gas that is drawn into the melt is preferentially retained at the surface between the particulate and the melt. Thus, while mixing can have the beneficial effect of promoting a distribution of the particles in the melt and wetting, the wrong type of mixing ultimately inhibits the wetting.

The mixing action can also nucleate undesirable gas bubbles in the melt in a manner similar to cavitation. Dissolved or entrapped gases are nucleated into bubbles in the region of low pressure immediately behind the blades of an improperly designed mixing impeller due to the reduced pressure there, and the bubbles preferentially attach to the particulate surfaces, also inhibiting wetting.

The mixing process of the present invention minimizes the incorporation of gases into the melt and the retention of adsorbed, dissolved and entrapped gases in the melt, with the result that there is a reduced level of gases in the melt to interfere with wetting of the metal to the particles.

The mixing process also creates a state of high shear rates and forces between the molten metal and the solid particles in the melt. The shear state helps to remove adsorbed gas and gas bubbles from the surface of the particulate by the physical mechanism of scraping and scouring the molten metal against the solid surface, so that contaminants such as gases and oxides are cleaned away. The shear also tends to spread the metal onto the surface, so that the applied shear forces help to overcome the forces otherwise preventing spreading of the metal on the solid surface. The shearing action does not deform or crack the particles, instead shearing the liquid metal rapidly past the particles.

In the preferred approach, a vacuum is applied to the surface of the melt. The vacuum reduces the incorporation of gas into the melt through the surface during mixing. The vacuum also aids in removing gases from the melt. A vacuum need not be used if other techniques are employed to minimize introduction of gas into the molten metal and to minimize retention of gas in the molten metal.

Preparation of a composite of a metallic alloy, preferably aluminum or an aluminum alloy, reinforced with particles of a nonmetallic material, preferably silicon carbide, begins with melting the aluminum alloy. A wide range of standard wrought, cast, or other aluminum alloys may be used, as, for example, 6061, 2024, 7075, 7079, and A356. There is no known limitation to the type of alloy. Alloys that contain volatile constituents such as magnesium and zinc have been used successfully, with the vacuum and alloy chemistry controlled in the manner to be described.

Before the particles are added, it is preferred but not necessary to clean the melt to remove oxides, particles, dissolved gas, and other impurities that inhibit wetting. In one approach, a nonreactive gas such as argon gas is bubbled through the melt for a period of time, as about 15 minutes, before particles are added. The argon gas bubbles to the surface, carrying with it dissolved and entrapped gases that diffuse into the argon bubble as it rises, and also forcing solids floating in the metal to the surface.

Particles of the nonmetallic refractory ceramic material are added to and mixed with the molten metal. The particles must exhibit a sufficiently low degree of degradation by chemical reaction with the molten metal under the conditions of mixing and casting. That is, a particulate that dissolves into the molten metal under all known conditions is not acceptable, nor is a particulate that forms an undesirable reaction product in contact with the molten metal. On the other hand, most nonmetallics react extensively with molten metals at high temperatures, but in many cases the reaction can be reduced to an acceptable level by controlling the temperature of the molten metal to a temperature whereat there is no substantial degree of reaction during the time required for processing.

The preferred nonmetallic reinforcement materials are metal oxides, metal nitrides, metal carbides and metal silicides. Of these, silicon carbide, aluminum oxide, boron carbide, silicon nitride and boron nitride are of particular interest. The most preferred particulate is silicon carbide, which is readily procured, is inexpensive, and exhibits the necessary combination of physical properties and reactivity that desirable composites may be made using the present approach. Both high-purity green and low-purity black silicon carbide have been found operable.

The amount of particulate such as silicon carbide added to the melt may vary substantially, with the maximum amount being dependent upon the ability to stir the melt containing the particles to achieve homogeneity. With increasing amounts of particulate, the melt becomes more viscous and harder to stir. Higher amounts of silicon carbide also provide increased surface area for the retention and stabilization of gas within the melt, limiting the ability to prepare a sound, wetted material. The maximum amount of silicon carbide in aluminum alloys has been found to be about 40 volume percent. The size and shape of the silicon carbide particles may also be varied.

A combination of the molten metal and the particles, prior to mixing, is formed by a convenient method. The particles may be added to the surface of the melt or below the surface, although in the latter case the particles typically rise to the surface unless mixing is conducted simultaneously to achieve partial or complete wetting. The particles can also be added with the pieces of metal before the metal is melted, so that the particles remain with the metal pieces as they are melted to form the melt. This latter procedure is not preferred, as it is desirable to clean the melt prior to addition of the particulate, so that the particulate is not carried to the surface with the cleaning gas.

The particulate and the molten metal are then mixed together for a time sufficient to wet the molten metal to the particles. The mixing is conducted under conditions of high shear strain rate and force to remove gas from the surface of the particulate and to promote wetting. The mixing technique must also avoid the introduction of gas into the melt, and avoid the stabilizing of entrapped and dissolved gas already in the melt.

Figure 2:
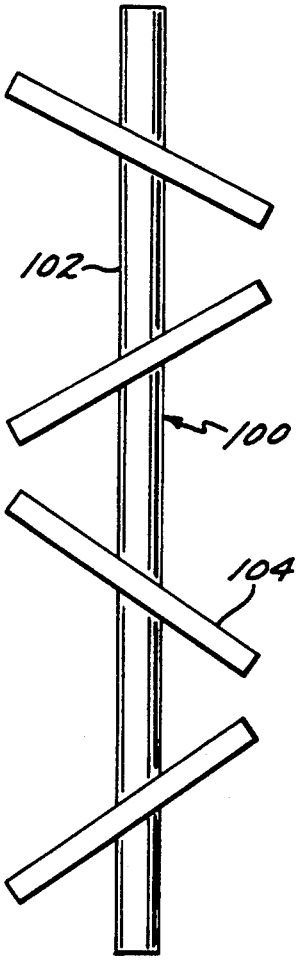
FIG. 2 is an elevational view of a dispersing impeller.

The preferred approach to mixing uses a dispersing impeller immersed into the melt and operated so as to induce high shears within the melt but a small vortex at the surface of the melt. A dispersing impeller meeting these requirements is illustrated in FIG. 2. This dispersing impeller 100 includes a dispersing impeller shaft 102 having a plurality of flat blades 104. The blades 104 are not pitched with respect to the direction of rotation, but are angled from about 15° to about 45° from the line perpendicular to the shaft 102. This design serves to draw particulate into the melt while minimizing the appearance of a surface vortex and minimizing gas bubble nucleation in the melt. Tests have demonstrated that this dispersion impeller can be rotated at rates of up to at least about 2500 revolutions per minute (rpm) without inducing a significant vortex at the surface of aluminum alloy melts. A high rate of rotation is desirable, as it induces the highest shear rates and forces in the molten mixture and reduces the time required to achieve wetting.

The melt is mixed with the dispersing impeller for a time sufficient to accomplish wetting of the metal to the particulate and to disperse the particulate throughout the metal. Empirically, a total mixing time of about 70 minutes has been found satisfactory.

The temperature of mixing should be carefully controlled to avoid adverse chemical reactions between the particles and the molten metal. The maximum temperature of the metal, when in contact with the particles, should not exceed the temperature at which the particles chemically degrade in the molten metal. The maximum temperature is dependent upon the type of alloy used, and may be determined for each alloy. While the molten alloy is in contact with the particulate, the maximum temperature should not be exceeded for any significant period of time.

For example, the maximum temperature is about 20° C. above the alloy liquidus temperature for silicon carbide particulate alloys containing significant amounts of reactive constituents such as magnesium, zinc and lithium. The maximum temperature is about 70° C. above the alloy liquidus temperature for common alloys that do not contain large amounts of reactive or stabilizing elements. The maximum temperature is about 100° C. to about 125° C. above the alloy liquidus where the alloy contains larger amounts of elements that stabilize the melt against reaction, such as silicon. If higher temperatures than those described are used, it is difficult or impossible to melt, mix and cast the alloy because of increased viscosity due to the presence of the dissolved material. A reaction zone around the particles is formed, probably containing silicides.

The maximum temperature also depends upon the reactivity of the particulate, which is determined primarily by its chemical composition. Silicon carbide is relatively reactive, and the preceding principles apply. Aluminum oxide is relatively nonreactive in aluminum and aluminum alloys, and therefore much higher temperatures can be used.

In a prior approach termed rheocasting, the metal and particulate were mixed in the range between the solidus and the liquidus of the alloy. In this range, solid metal is formed in equilibrium with the liquid metal, and the solid metal further increases the viscosity and the shear forces, making the mixing even more effective. However, it has now been found that the use of temperatures substantially below the liquidus results in extensive and undesirable segregation of alloying elements in the metallic phase after the composite is solidified. The material also cannot be readily cast using conventional casting procedures.

The molten mixture is therefore maintained in the temperature range of a minimum temperature where there is substantially no solid metallic phase formed in equilibrium with the liquid metal, to a maximum temperature whereat the particles do not chemically degrade in the molten metal. The minimum temperature is about the liquidus of the molten metal, although lower temperatures can be sustained briefly. Temperature excursions to lower temperatures are not harmful, as long as the melt is cast without a metallic phase present. For example, when the particulate or alloying additions are added to the melt, there can be a normal brief depression of the temperature. The temperature is soon restored without incident. The maximum temperature is limited by the onset of degradation of the particulate in the liquid metal. Brief excursions to higher temperatures are permitted, as long as they do not cause significant degradation of the particulate, but such higher temperatures should not be maintained for extended periods of time.

After mixing is complete, the composite can be cast using any convenient casting technique. After mixing with the impeller is discontinued, the melt is substantially homogeneous and the particles are wetted by the metal so that the particles do not tend to float to the surface. Casting need not be accomplished immediately or with a high-rate casting procedure. Bottom fed pressure casting is preferred.

The resulting cast material may be made into products by conventional metallurgical procedures. The composite can be annealed and heat treated. It can be hot worked using, for example, extrusion or rolling in conventional apparatus. The final composite can also formed by new techniques such as solid phase casting, wherein the cast composite is heated to a temperature between the solidus and liquidus of the metallic alloy, so that liquid alloy is formed, and then forced into a die or mold to solidify.

Figure 3:
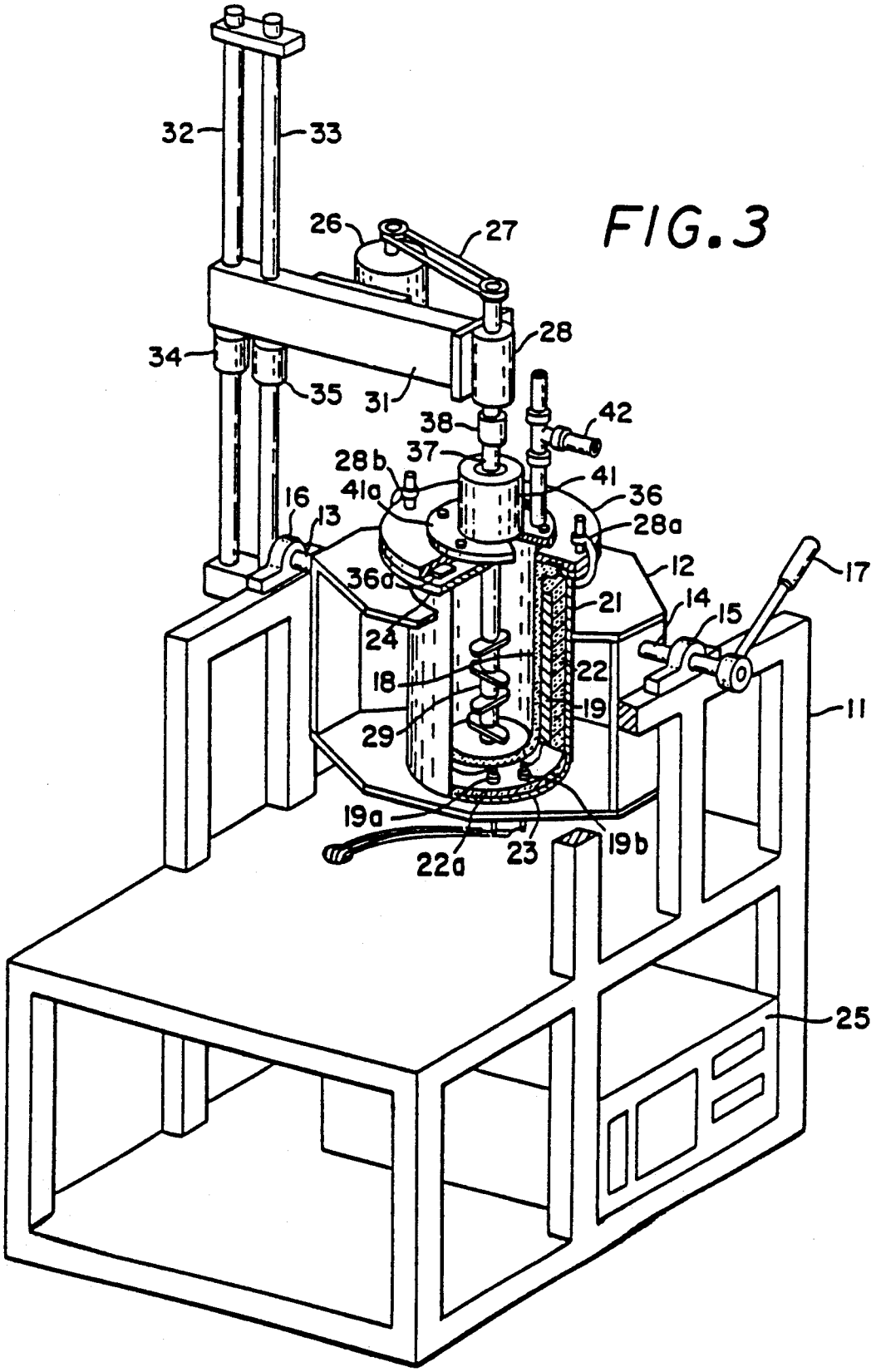
FIG. 3 is a perspective view of the mixing apparatus using a dispersing impeller, with portions broken away for clarity.
Figure 4:
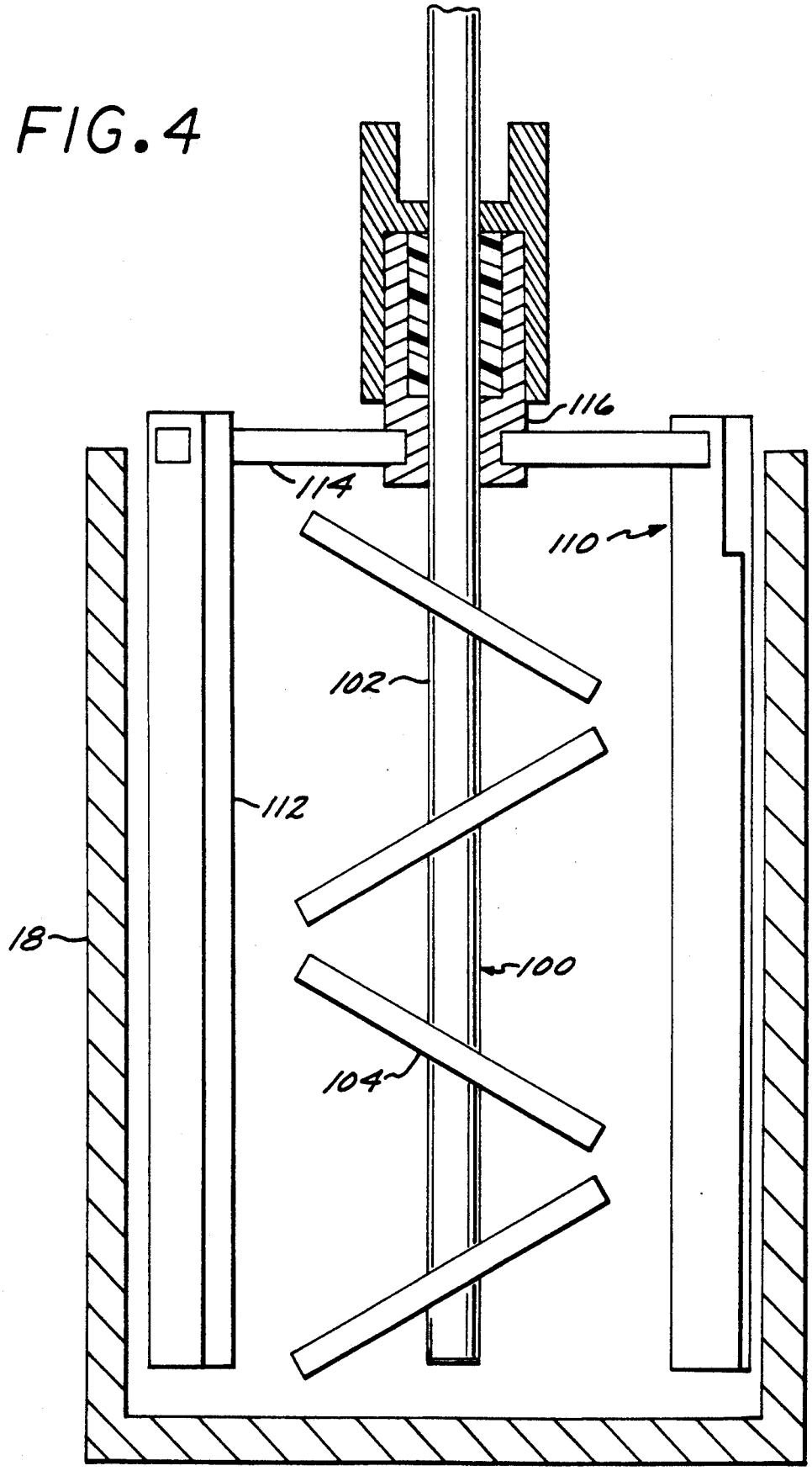
FIG. 4 is a side sectional view of a mixing apparatus having both a dispersing impeller and a sweeping impeller.

Apparatus for preparing a composite material by casting is illustrated in FIGS. 3 and 4. Referring to FIG. 3, the apparatus comprises a metal stand 11, upon which is supported a rotatable furnace holder 12. The furnace holder 12 is equipped with shafts 13 and 14 secured thereto, that are in turn journaled to pillow blocks 15 and 16. A handle 17 secured to shaft 16 is used to rotate the holder 12 as desired for melting or casting.

A crucible 18 is formed of a material which is not substantially eroded by the molten metal. In one embodiment, the crucible 18 is formed of alumina and has an inside diameter of 3¾ inches and a height of 11 inches. This crucible is suitable for melting about 5 pounds of aluminum alloy. The crucible is resistively heated by a heater 19, such as a Thermcraft No. RH274 heater. The heated crucible is insulated with Watlow blanket insulation 22 and a low density refractory shown at 22*a*. The insulated assembly is positioned inside a 304 stainless steel pipe which has a ¼ inch thick solid base 23 and a top flange 24 welded thereto, to form container 21. Container 21 serves not only as a receptacle for crucible 18, but also functions as a vacuum chamber during mixing. The power for heater 19 is brought through two Varian medium power vacuum feedthroughs 19*a* and 19*b*. Two type K thermocouples positioned between crucible 18 and heater 19 are used for temperature monitoring and control, and are brought into container 21 with Omega Swagelock-type gas-tight fittings (not shown).

The temperature of crucible 18 is controlled with an Omega 40 proportional controller 25 which monitors the temperature between the crucible and the heater. Controller 25 drives a 60 amp Watlow mercury relay, which switches 215 volts to heater 19, the temperature being monitored with a Watlow digital thermometer.

The mixing assembly consists of a ¼ horsepower Bodine DC variable speed motor 26 controlled by a Minarik reversible solid state controller (not shown). The motor 26 is secured to an arm 31 and is connected by cog belt 27 to a ball bearing spindle 28 which is supported over the crucible 18 and holds the rotating dispersion impeller 29.

The spindle 28 is secured to the arm 31 which is slidingly connected to supports 32 and 33 to permit vertical movement of the arm 31. Clamps 34 and 35 can be locked to secure arm 31 in the position desired.

The dispersion impeller 29 is machined from 304 stainless steel and welded together as necessary, bead blasted, and then coated with Aremco 552 ceramic adhesive. The coated impeller 29 is kept at 200° C. until needed.

The dispersion impeller 29 is positioned vertically along the centerline of the crucible. Optionally, and preferably, a second impeller termed a sweeping impeller 110 is also positioned in the crucible to move particles and molten metal into the vicinity of the dispersing impeller 29. The primary shearing action to promote mixing and wetting is provided by the dispersing impeller 29, but the sweeping impeller 110 aids in bringing particles and metal into the active region of the mixing, and into the influence of the dispersing impeller 29. The sweeping impeller 110 also creates a fluid flow adjacent the inner walls of the crucible, preventing a buildup of particulate matter adjacent the walls. The use of the sweeping impeller 110 is particularly desirable for larger size crucibles. When larger crucibles are used, the particulate tends to collect at the surface of the outer periphery of the melt and may not be mixed into the melt unless it is forced from the wall toward the center of the melt and moved toward the dispersing impeller 29.

As illustrated in FIG. 4, the sweeping impeller 110 comprises a pair of blades 112 whose broad faces are oriented in the circumferential direction. The blades 112 are positioned adjacent the inner wall of the crucible 18, but not touching the inner wall, by blade arms 114. The blade arms 114 are attached to a sweeping impeller shaft 116, whose cylindrical axis is coincident with that of the dispersing impeller shaft 102. The sweeping impeller shaft 116 is hollow and concentric over the dispersing impeller shaft 102, with the dispersing impeller shaft 102 passing down its center. The sweeping impeller shaft 116 is supported by bearings independent of the dispersing impeller shaft 102, so that the sweeping impeller shaft 116 and the dispersing impeller shaft 102 turn independently of each other. In practice, the sweeping impeller shaft 116 and blades 112 are rotated by a motor (not shown) at a much slower rate than the dispersing impeller 100. The sweeping impeller 100 is typically rotated at about 45 rpm to move particulate away from the crucible walls and toward the dispersing impeller 100, while the dispersing impeller is rotated at about 2500 rpm to draw the particulate into the melt with a minimum vortex and to promote wetting of the particulate.

Returning to the view of the apparatus shown in FIG. 3, a removable metal flange 36 covers the container 21, with a gasket 36*a* between the upper flange of the container 21 and the flange 36, and can be sealed in an airtight manner by clamps 28*a* and 28*b*. A shaft 37 is releasably secured to spindle 28 by means of a chuck 38 and passes through vacuum rotary feed-through 41, equipped with a flange 41*a*.

A port 42 equipped with a tee-fitting in flange 41*a* permits ingress and egress of argon from a source (not shown), and is adapted for application to a vacuum line to permit evacuation of the crucible 18.

Figure 5:
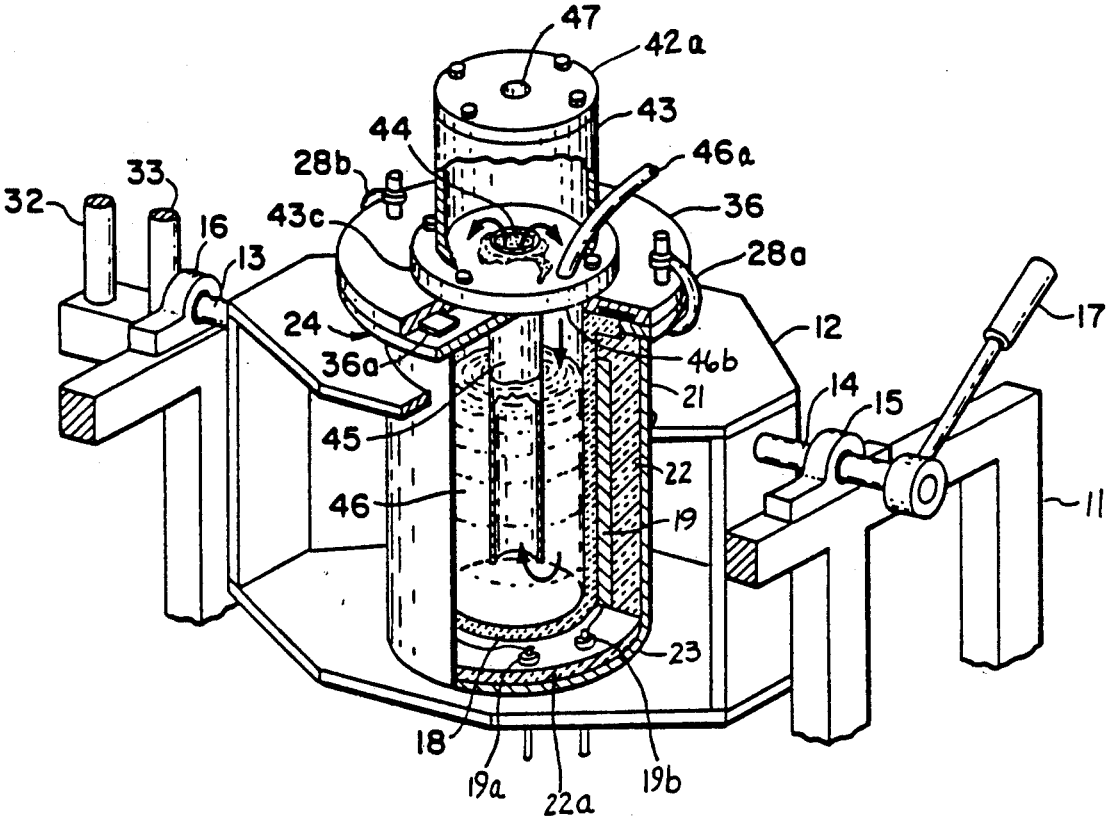
FIG. 5 is a perspective view of the casting apparatus, with portions broken away for clarity.

When mixing is complete, the mixing head is removed and replaced with a casting head. Referring to FIG. 5, the pressure casting assembly includes a stainless steel cylindrical mold 43. This mold 43 is comprised of a top 42*a*, a flanged bottom 43*c*, and a tubular midsection, bolted together as illustrated. The flanged bottom 43*c* of mold 43 has a machined port 44 through which a heavily oxidized 304 stainless steel tube 45 is pressed and locked in place with a set screw (not shown). Tube 45 is immersed in the liquid composite melt 46, the end of the tube 45 being positioned within ½ inch from the bottom of the crucible 18.

The bottom 43*c* of the mold 43 is bolted to the top flange 36 which is clamped by means of clamps 28*a* and 28*b* to container flange 24. A silicone gasket 36*a* provides a pressure seal.

A port 46*b* in the flanged bottom 43*c* of the mold 43 serves as an inlet for low pressure air entering through the tube 46*a*, which pressurizes the chamber causing the molten aluminum composite material to rise up tube 45 filling mold 43. Opening 47 in the mold top 42*a* vents air during the pressure casting process.

In carrying out the process of the present invention to prepare the preferred composite material of silicon carbide particulate in an aluminum alloy matrix, the heater is activated and the controller set so that the temperature is above the liquidus of the aluminum alloy. The aluminum alloy is then placed into the crucible and when the alloy has melted, any other alloying elements which are to be incorporated into the melt are added. The temperature is thereupon reduced somewhat and the melt is blown with argon by bubbling the gas through the melt. Silicon carbide particulate is then added to the melt, the mixing assembly put in place, a vacuum pulled, and mixing begun. Periodically the chamber is opened to permit cleaning of the crucible walls, if necessary, while maintaining an argon cover over the surface of the melt.

After sufficient mixing has occurred, the mixing assembly is removed, and is replaced by the pressure casting head and mold. The composite melt is then forced into the mold, by air pressure. When the cast composite has cooled, it is removed from the mold.

The following examples serve to illustrate aspects of the invention, but should not be taken as limiting the scope of the invention in any respect.

EXAMPLE I

This Example I illustrates the preparation of 6061 aluminum-silicon carbide composite. Before mixing the following steps are taken. The impeller 29 which has been previously bead blasted clean is given three coatings of Aremco 552 adhesive ceramic coating and after the last coating is cured, is kept at 200° C. prior to mixing, in order to keep it dry. The silicon carbide powder (600 mesh) is also maintained at 200° C. to drive off any adsorbed water. The metal to be used in the heat is cut into convenient size and weight. In this example, the metal consists of 6061, A520 (10% Mg-Al) and A356 (7% Si-Al) aluminum alloys. The pressure casting mold is assembled and warmed with heat tape to 300° C.

The mixing furnace is started and the temperature set at 850° C.–870° C. The crucible 18 is quickly warmed.

1790 grams of 6061 bar stock are now charged to the crucible 18 and the argon cover gas is turned on for entry through port 42. The A520 stock is held back due to its extremely low melting point and susceptibility to oxidation. As the 6061 begins to melt, the temperature is reduced to 680° C. (680° C.–720° C. is a workable range). 245 grams of A520 and 23 grams of A356 are then added to the molten 6061.

Argon is blown into the melt at the rate of 100 cc/min, for 15 minutes, displacing any adsorbed hydrogen, and bringing oxide particles to the surface, which are skimmed off. 655 grams of 600 grit silicon carbide are then added to the melt, the mixing assembly put in place, and a vacuum pulled on crucible 18 through port 42, to 15–20 torr or lower.

The mixer motor 26 is then turned on and the impeller 29 set to rotate at approximately 750 rpm. After 5 minutes of mixing the chamber is brought to atmospheric pressure with argon, the vacuum feedthrough is lifted slightly, and any excess silicon carbide powder coating the walls is scraped back into the melt. The chamber is then resealed and evacuated. This cleaning is repeated two more times at 5 minute intervals. The melt is stirred for a total mixing time of 50 minutes, and the motor then stopped.

The pressure casting head of FIG. 5 with the heated mold and fill tube 45 is now clamped into place, and the fill tube 45 immersed in the molten aluminum composite 46 to nearly the bottom of the crucible. The inside of the chamber is then slowly pressurized to 1.5 psi (pounds per square inch) through an external valve, a small compressor supplying the pressure. This low pressure forces the composite up the fill tube into the mold.

When the aluminum seeps out of the small vent hole 47 and seals it, the pressure is raised to 9 psi until the metal within the mold is completely solidified.

After the metal cools it is removed from the mold.

The process for the fabrication of a 6061 aluminum alloy-silicon carbide composite defined in Example I may be further simplified, to no apparent detriment of the composite material, by eliminating the vacuum-pressure cycles encountered during the opening and closing of the mixing chamber for the purpose of cleaning the walls of the crucible. This is accomplished by performing the first part of the mixing and cleaning under an Argon cover at atmospheric pressure followed by the completion of mixing under a vacuum of 10–20 torr which removes most dissolved gases and insures effective wetting of the SiC particulate.

The following example illustrates the preparation of a 6061-600 mesh silicon carbide composite using a thus-modified procedure.

EXAMPLE II

As in Example I, after bead blasting the impeller is given three coats of Aremco 552 adhesive ceramic coating and maintained at 200° C. prior to mixing. The silicon carbide is also kept dry at 200° C.

1795 grams of 6061 bar stock, 250 grams of A520, and 23 grams of A356 are weighed out and cut into convenient sized pieces for charging into crucible 18.

The mixing furnace is started and controller temperature set at 850° C.–870° C.

The 6061 bar stock is charged into crucible 18 and the argon cover gas is turned on. As the 6061 begins to melt, the crucible temperature is reduced to 680° C. The A520 and A356 are then added to the molten 6061.

As in Example I, argon is blown into the melt for 15 minutes to displace any adsorbed hydrogen and to lift suspended oxide particles to the surface. 655 grams of 600 mesh silicon carbide are then added to the melt, the mixing assembly put into place and an argon flow maintained over the melt through port 42.

The mixing motor 26 is turned on and impeller 29 set to rotate at approximately 750 rpm. After 5 minutes of mixing, the motor is stopped, the silicon carbide powder coating the walls is scraped into the melt and the motor restarted. This cleaning is repeated two more times. After 40 minutes of mixing under argon at atmospheric pressure, the mixing chamber is slowly evacuated to 10-20 torr while the melt is being continually stirred. After a total mixing time of 50 minutes, the motor is stopped.

As in Example I, the pressure casting head shown in FIG. 5 is now clamped into place, and the outside of the mixing chamber pressurized through port 46 using a small compressor. This low pressure forces the composite up the fill tube 45 to fill the mold 43. When aluminum seeps out of the vent hole 47 and solidifies, sealing the hole, the pressure is raised to 9 psi until solidification is complete. After cooling, the metal is removed from the mold.

By controlling mixing of the silicon carbide powder into liquid 6061 alloy as set out in the above Examples I and II, it is possible to fabricate a composite material which demonstrates near-theoretical rule-of-mixtures modulus with good strength and ductility.

The preceding Examples I–II were performed using only a dispersing impeller. The following Examples III–VI were performed using a larger crucible having a dispersing impeller and a sweeping impeller.

EXAMPLE III

Example III describes the preparation of about 7000 cubic centimeters (cc) of 15 volume percent silicon carbide in 2219 aluminum alloy.

The dispersing impeller and the sweeping impeller were given three successive coatings of Aremco ultrabond alumina ceramic and dried at 200° C. after each coat. The two impellers were maintained at 200° C. thereafter to avoid absorption of water by the ceramic coating.

The 2219 metal was weighed out to 16,900 grams and cut into convenient shapes to fit into the crucible and then heated in a small box furnace at 535° C. to dry and preheat it. 3370 grams of silicon carbide powder was weighed and placed into an oven at 200° C. to remove moisture.

The mixing crucible was heated to 850° C. and the preheated 2219 metal was placed into the crucible. The 2219 alloy melted and the crucible temperature was reduced to a melt temperature of 665° C.

A ceramic tube was inserted into the molten aluminum alloy and argon bubbled through the melt for about 15 minutes. The rising argon bubbles degas the melt and lift dross to the surface. The dross was skimmed and discarded.

The silicon carbide particulate was added to the surface of the melt in the crucible. The dried dispersing and sweeping impellers were bolted into place on the head assembly, and the head assembly was lowered so that the impeller blades pass through the silicon carbide layer floating on the melt and into the molten metal. The head assembly was then clamped into place to sealing the crucible and the entire vessel. A vacuum of about 20 torr was then drawn on the chamber.

The two impellers were then set in motion. The rotational speeds of the impellers was gradually increased over a period of 20 minutes to about 2500 rpm for the dispersing impeller and 45 rpm for the sweeping impeller. Mixing was continued thereafter for about 50 minutes.

The mixing was stopped and the chamber vented with argon to atmospheric pressure. The mixing head and impellers were then lifted out to reveal a crucible containing only liquid composite, without any appearance of silicon carbide not having been incorporated into the melt.

The low-pressure casting assembly was then lowered into place with the fill tube extending near the bottom of the melt. The head was clamped into place with a pressure-tight seal. A positive pressure of about 5 psi was slowly developed within the vessel. The liquid composite was then driven up the riser into the steel mold. After the metal had solidified, the pressure was reduced and the mold disassembled to remove the billet. Gravity casting was also successfully tried as an alternative procedure.

Figure 6:
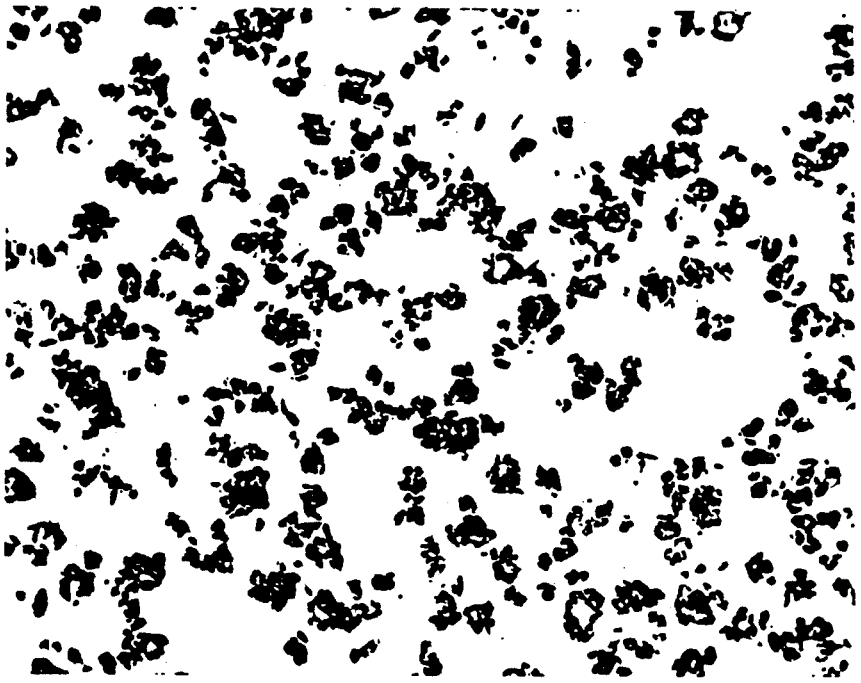
FIG. 6 is a pen-and-ink drawing of the microstructure of as-cast composite having 15 volume percent silicon carbide particles in a 2219 alloy matrix.
Figure 7:
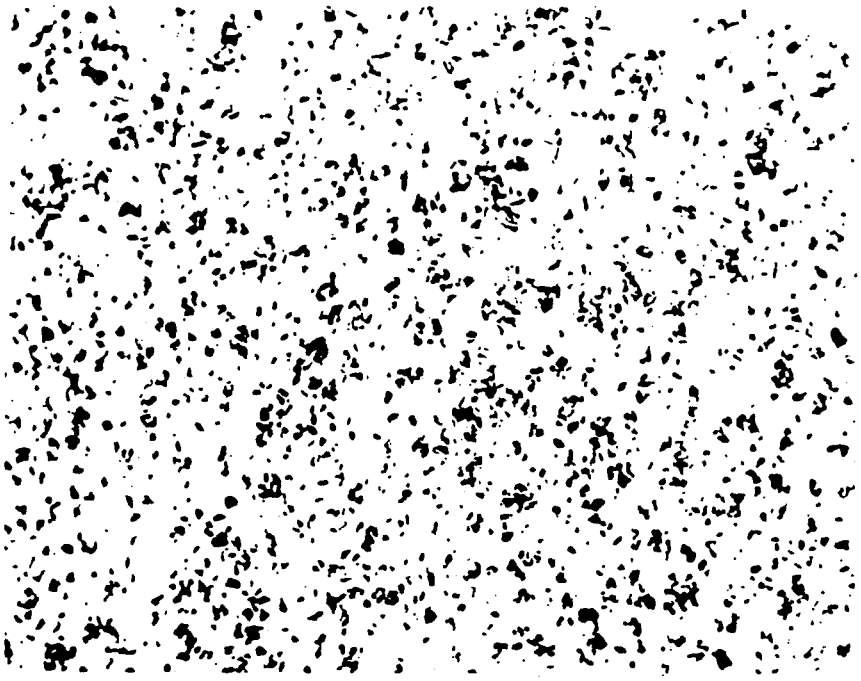
FIG. 7 is a transverse view pen-and-ink drawing of the microstructure of the material of FIG. 6, after extrusion to a reduction in area of about 11 to 1, at a temperature of 940° F.
Figure 8:
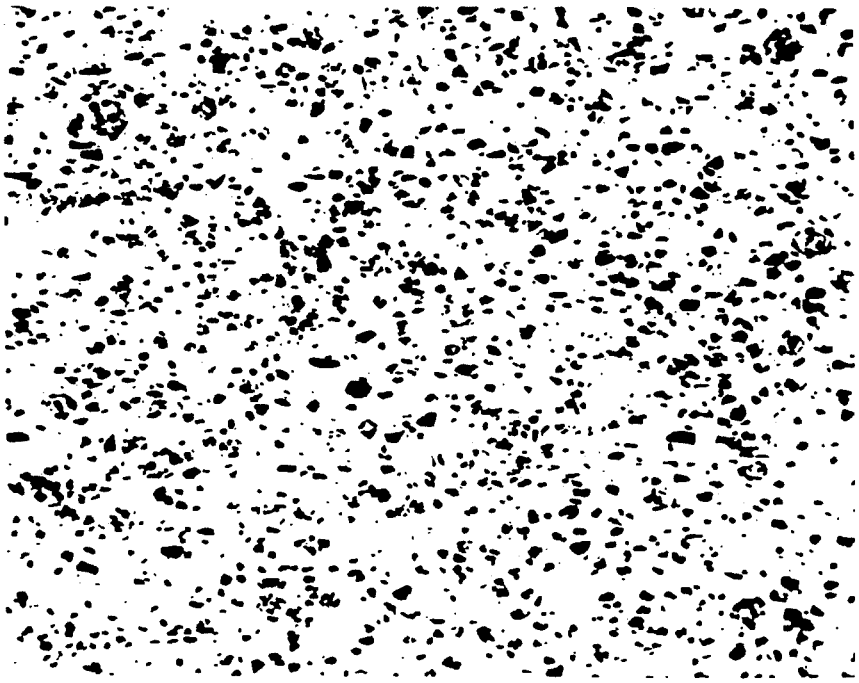
FIG. 8 is a transverse view pen-and-ink drawing of the microstructure of the material of FIG. 6, after rolling to a reduction in area of about 100 to 1, at a temperature of 900° F.

Samples of the cast composite were extruded, and other samples were rolled. FIGS. 6–8 illustrate the as-cast, extruded and rolled microstructures.

Mechanical properties were measured for 2219-T6 material without silicon carbide particulate reinforcement (0 volume percent) and the 15 volume percent material made in accordance with this Example III. The results are reported in the following table:

TABLE I

| SiC Content (%) | Test Temp (C) | Yield Str. (ksi) | Ultimate Strength (ksi) | Failure Elong. (%) | Elastic Modulus (msi) |
|---|---|---|---|---|---|
| 0 | 75 | 40.6 | 58.0 | 12.0 | 10.0 |
| 15 | 75 | 46.6 | 58.0 | 2.9 | 15.2 |
| 0 | 350 | 29.0 | 39.5 | 18.5 | 9.2 |
| 15 | 350 | 43.6 | 52.4 | 3.1 | 15.0 |
| 0 | 450 | 22.5 | 30.5 | 20.5 | 8.5 |
| 15 | 450 | 37.6 | 46.4 | 4.3 | 14.5 |
| 0 | 600 | 8.0 | 10.0 | 40.0 | 7.0 |
| 15 | 600 | 21.4 | 26.0 | 9.4 | 13.3 |

EXAMPLE IV

This Example IV describes the procedure for preparing about 7000 cc of 15 volume percent silicon carbide fibers in A357 aluminum, which has a high silicon content.

The impellers were prepared as described in Example III.

3370 grams of silicon carbide was weighed out and placed into a convection oven at 200° C. to remove adsorbed moisture. 15,780 grams of A357 and 540 grams of A520 (10 weight percent magnesium, balance aluminum) was weighed out, and the A357 is preheated at 530° C. The 540 grams of A520 increases the magnesium content of the melt to account for the magnesium loss during melting, which was determined empirically.

The crucible was preheated to 850° C., and the preheated A357 alloy melted. The A520 was added to the liquid melt. The temperature was reduced to maintain a melt temperature of 660° C.

The remainder of the procedure of adding silicon carbide, mixing and casting was as described in Example III.

Figure 9:
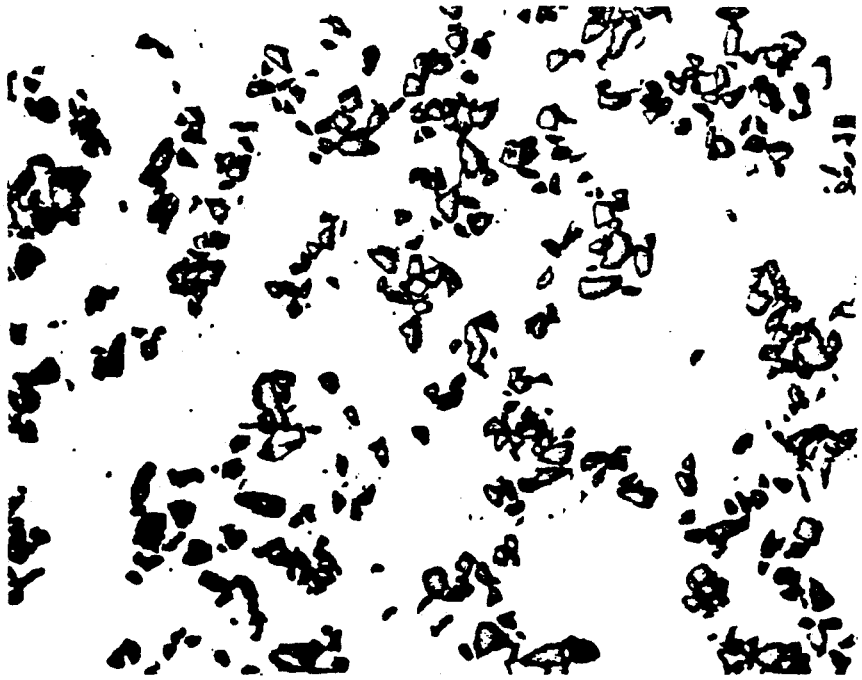
FIG. 9 is a pen-and-ink drawing of the microstructure of an as-cast composite of 15 volume percent silicon carbide particles in an A357 matrix.

FIG. 9 shows the microstructure of the resulting cast alloy.

After hot isostatic pressing, this material had a yield strength of 52 ksi (thousand pounds per square inch), an ultimate strength of 56 ksi, an elongation at failure of 1.0 percent, and a modulus of 13.4 msi (millions of pounds per square inch).

EXAMPLE V

Example V describes the preparation of about 7000 cc of 32 volume percent of silicon carbide in A356 aluminum alloy.

The impellers were prepared as discussed in Example III.

7180 grams of silicon carbide is weighed and placed in a convection oven at 200° C. to remove adsorbed moisture. 12638 grams of A356 and 375 grams of A520 were weighed, and the A356 preheated at 530° C.

The crucible was preheated to 850° C. and the preheated A356 alloy melted. The A520 was added to the liquid melt. The temperature was reduced to maintain a melt temperature of 656° C.

The remainder of the procedure of adding silicon carbide, mixing and casting was as described in Example III.

EXAMPLE VI

Example VI describes the preparation of about 7000 cc of a composite having 15 volume percent of silicon carbide in 7075 aluminum alloy.

The impellers were prepared as described in Example III.

3880 grams of silicon carbide was weighed and placed in a convection oven at 200° C. to remove adsorbed moisture. 15315 grams of 7075 alloy, 1054 grams of A520 alloy, 230 grams of zinc, and 28 grams of copper shot were weighed, and the 7075 alloy preheated to 500° C.

The crucible was preheated to 850° C., and the preheated 7075 melted in the crucible. The A520, zinc and copper were added to the melt, and the temperature of the melt reduced to 660° C. The A520 provides replacement magnesium for that lost during mixing, and the zinc replaces zinc similarly lost, these losses occurring because the vacuum applied during mixing removes volatile elements in the melt. Copper adjusts the copper content of the melt. With these additions, the final composition of the matrix of the final cast composite is nearly that of 7075.

In the T6 condition, the composite material had a yield strength of 83 ksi, ultimate strength of 87.2 ksi, elongation at failure of 2.5 percent, and modulus of 14.2 msi.

The remainder of the procedure of adding silicon carbide, melting and casting was as described for Example III.

Examples I–VI demonstrate that a wide range of composites can be prepared with the method and apparatus of the invention. The particulate content can be varied, and different types of matrix alloys can be used. The examples demonstrate that empirically determined replacement additions can be made to compensate for volatile elements such as magnesium and zinc that are lost during the vacuum mixing procedure.

It will now be appreciated that the method and apparatus of the present invention produces particulate reinforced composite materials by a melting and casting procedure that is economical and produces high-quality material. Wetting is accomplished by minimizing the effect of gas in the matrix and mixing with a high shear rate. Although particular embodiments of the invention have been described in detail for purposes of illustration, various modifications may be made without departing from the spirit and scope of the invention. Accordingly, the invention is not to limited except as by the appended claims.

What is claimed is:

1. A composite material, comprising:

a matrix having a microstructure characteristic of casting from a temperature above the liquidus temperature of the matrix alloy; and a distribution of untreated and uncoated refractory particles dispersed throughout and wetted by the matrix, at least a portion of the particles having an aspect ratio of from 2 to 5.

2. The composite material of claim 1, wherein the matrix is selected from the group consisting of an aluminum-based alloy and a magnesium-based alloy.

3. The composite material of claim 1, wherein the matrix is an aluminum-based alloy.

4. The composite material of claim 1, wherein the particles are selected from the group consisting of a metal oxide, a metal nitride, a metal carbide, and a metal silicide.

5. The composite material of claim 1, wherein the particles are selected from the group consisting of silicon carbide and aluminum oxide.

6. The composite material of claim 1, wherein the particles are present in an amount of from about 5 to about 40 volume percent of the material.

7. A composite material, comprising:

a matrix of an aluminum-based alloy having a cast microstructure; and a distribution consisting of from about 5 to about 40 volume percent of wetted refractory particles dispersed throughout the matrix.

8. A composite material comprising:

a metallic matrix; and a distribution of wetted refractory particles within the matrix, the matrix and particles together having an as-cast microstructre characteristic of the solidification of a mixture of unconstrained refractory particles mixed into a molten metallic alloy.

9. The composite material of claim 8, wherein the matrix is selected from the group consisting of an aluminum-based alloy and a magnesium-based alloy.

10. The composite material of claim 8, wherein the matrix is an aluminum-based alloy.

11. The composite material of claim 8, wherein the particles are selected from the group consisting of a metal oxide, a metal nitride, a metal carbide, and a metal silicide.

12. The composite material of claim 8, wherein the particles are silicon carbide.

13. The composite material of claim 8, wherein the particles are aluminum oxide.

14. The composite material of claim 8, wherein the particles are present in an amount of from about 5 to about 40 volume percent of the material.

* * * * *